US009182710B2

(12) United States Patent
Watanabe

(10) Patent No.: US 9,182,710 B2
(45) Date of Patent: Nov. 10, 2015

(54) FIXING DEVICE INCLUDING A SEPARATION UNIT AND IMAGE FORMING APPARATUS THEREOF

(71) Applicant: Yohhei Watanabe, Kanagawa (JP)

(72) Inventor: Yohhei Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/143,123

(22) Filed: Dec. 30, 2013

(65) Prior Publication Data

US 2014/0212188 A1 Jul. 31, 2014

(30) Foreign Application Priority Data

Jan. 31, 2013 (JP) ..... 2013-016775

(51) Int. Cl.
*G03G 15/20* (2006.01)
*G03G 21/00* (2006.01)

(52) U.S. Cl.
CPC .... *G03G 15/2028* (2013.01); *G03G 2215/2032* (2013.01)

(58) Field of Classification Search
CPC ..... G03G 15/2028; G03G 15/2085
USPC ..... 399/124, 323, 398, 399
See application file for complete search history.

(56) References Cited

U.S. PATENT DOCUMENTS

| | | | | |
|---|---|---|---|---|
| 7,761,043 | B2 * | 7/2010 | Park | 399/323 |
| 2005/0276638 | A1 | 12/2005 | Yamada | |
| 2009/0297233 | A1 * | 12/2009 | Kameda | 399/322 |

FOREIGN PATENT DOCUMENTS

| | | |
|---|---|---|
| JP | 2-173686 | 7/1990 |
| JP | 2005-352382 | 12/2005 |
| JP | 2007-304301 | 11/2007 |
| JP | 2008-040364 | 2/2008 |
| JP | 2008-040365 | 2/2008 |
| JP | 2010-079219 | 4/2010 |
| JP | 2010-191275 | 9/2010 |
| JP | 2011-197357 | 10/2011 |
| JP | 2011-221067 | 11/2011 |

* cited by examiner

*Primary Examiner* — Joseph S Wong
(74) *Attorney, Agent, or Firm* — Harness, Dickey & Pierce, P.L.C.

(57) ABSTRACT

A fixing device includes a fixing member, a heating device for heating the fixing member, a pressure member, and a separation unit. The pressure member is pressed against the fixing member to form a fixing nip for receiving a recording medium carrying an unfixed toner image and fixing the unfixed toner image on the recording medium. The separation unit has a surface facing the fixing member and having an opening therein. The separation unit includes a separation member and a removable rubbing member. The separation member disposed in the opening in the separation unit to be located near an exit of the fixing nip separates the recording medium from the fixing member. The rubbing member is housed in the separation unit and contactable with the fixing member through the opening in the separation unit, and rubs against a surface of the fixing member.

20 Claims, 9 Drawing Sheets

FIXING DEVICE INCLUDING A SEPARATION UNIT AND IMAGE FORMING APPARATUS THEREOF

CROSS-REFERENCE TO RELATED APPLICATION

This patent application is based on and claims priority pursuant to 35 U.S.C. §119 to Japanese Patent Application No. 2013-016775, filed on Jan. 31, 2013, in the Japan Patent Office, the entire disclosure of which is hereby incorporated by reference herein.

BACKGROUND

1. Technical Field

The present invention relates to a fixing device and an electrophotographic image forming apparatus, such as a copier, a printer, a facsimile machine, or a multifunction machine combining the functions of at least two of these apparatuses.

2. Related Art

A typical electrophotographic image forming apparatus includes a fixing device that includes a fixing member and a pressure member for forming a fixing nip, receives a recording medium (i.e., sheet) carrying an unfixed toner image and fed to the fixing nip, and fixes the unfixed toner image on the recording medium with heat and pressure. If recording media of a predetermined size in the width direction of the fixing member pass through this type of fixing device, the side edges of the recording media pass through the same positions. If most of recording media used in the image forming apparatus have the same size, therefore, the side edges of the recording media mostly pass through the same positions on the fixing member. The edges of recording media are burred in a cutting process, and the burred edges of the recording media passing through the same positions on the fixing member damage portions of a surface of the fixing member through which the burred edges pass. As a result, image defects such as streaky unevenness in density appear in the image, degrading the image quality.

To address the above-described issue, the fixing device may be configured to include a rubbing member capable of grinding and restoring the surface of the fixing member damaged by the edges of the recording media.

The rubbing member provided in the fixing device, however, increases the size of the fixing device and thus the overall size of the image forming apparatus. Further, the rubbing member has a relatively short lifespan with the restoration performance thereof degraded with time. It is therefore desirable to periodically replace the rubbing member with a new one, and therefore a fixing device allowing easy replacement of the rubbing member is desired.

SUMMARY

The present invention provides an improved fixing device that, in one example, includes a fixing member, a heating device, a pressure member, and a separation unit. The heating device is configured to heat the fixing member. The pressure member is configured to be pressed against the fixing member to form a fixing nip for receiving a recording medium carrying an unfixed toner image and fixing the unfixed toner image on the recording medium. The separation unit has a surface facing the fixing member and having an opening therein. The separation unit includes a separation member and a removable rubbing member. The separation member is disposed in the opening in the separation unit to be located near an exit of the fixing nip, and is configured to separate the recording medium from the fixing member. The rubbing member is housed in the separation unit and contactable with the fixing member through the opening in the separation unit, and is configured to rub against a surface of the fixing member.

The present invention further provides an improved image forming apparatus including the above-described fixing device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
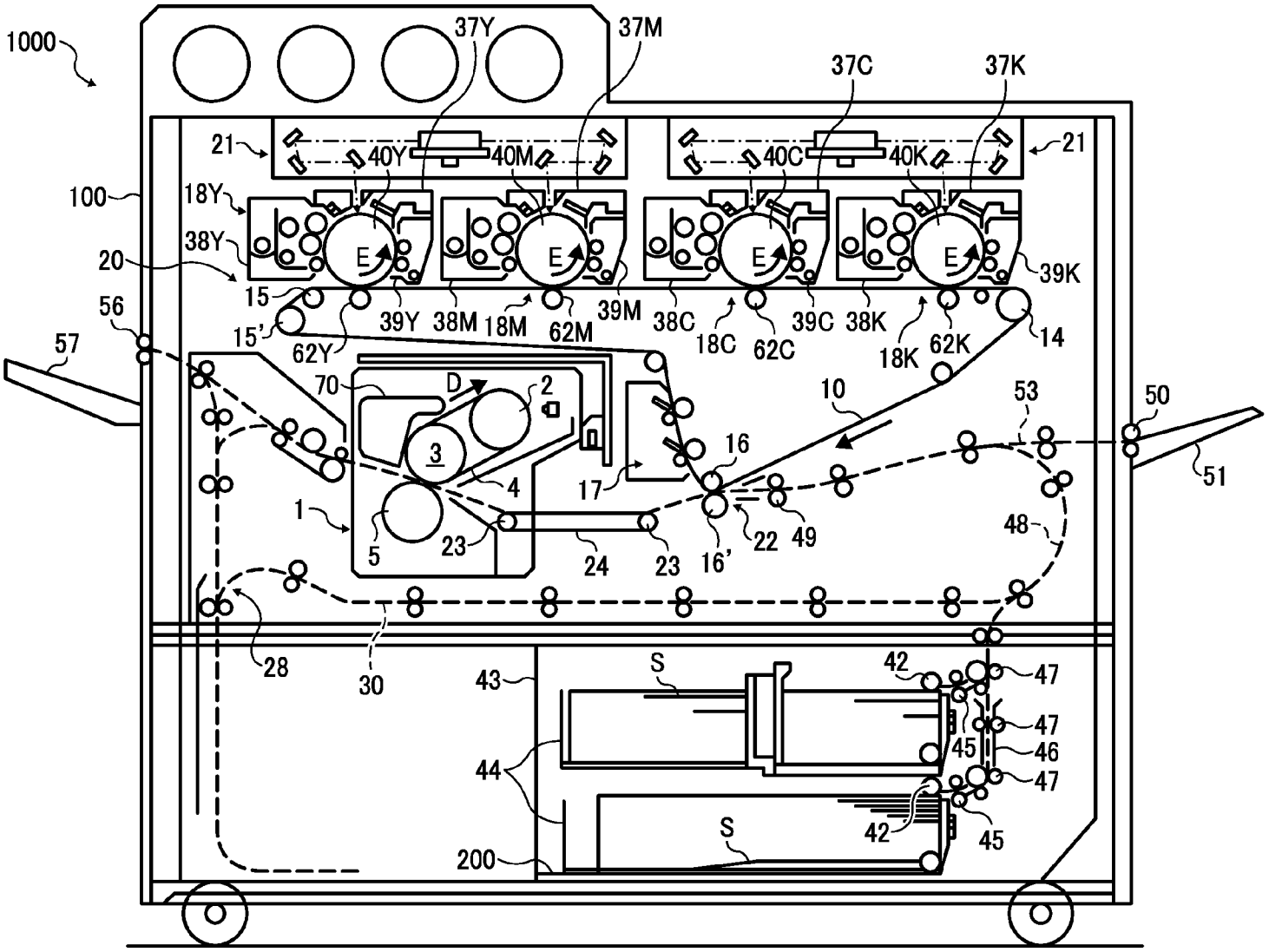
FIG. 1 is a schematic diagram illustrating an overall configuration of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

FIG. 1 is a schematic diagram illustrating an image forming apparatus 1000 according to an embodiment of the present invention. FIG. 1 illustrates a tandem, intermediate-transfer, full-color printer as an example of the image forming apparatus 1000. The image forming apparatus 1000 illustrated in FIG. 1 includes a main unit 100 and a sheet feeding table 200 situated under the main unit 100 to hold the main unit 100 placed thereon.

The main unit 100 includes a tandem image forming unit 20, an endless intermediate transfer belt 10, two exposure devices 21, a fixing device 1, a sheet reversing device 28, and so forth.

The tandem image forming unit 20 includes four laterally aligned image forming units 18Y, 18M, 18C, and 18K serving as image forming devices. The suffixes Y, M, C, and K following the reference numeral 18 of the image forming units 18Y, 18M, 18C, and 18K represent yellow, magenta, cyan, and black colors, respectively (hereinafter referred to as the Y, M, C, and K colors).

The image forming units 18Y, 18M, 18C, and 18K include drum-shaped photoconductors 40Y, 40M, 40C, and 40K serving as image carriers for carrying toner images of the Y, M, C, and K colors, respectively. The image forming units 18Y, 18M, 18C, and 18K are similar in configuration, and further include charging devices 37Y, 37M, 37C, and 37K, development devices 38Y, 38M, 38C, and 38K, and photoconductor cleaning devices 39Y, 39M, 39C, and 39K, respectively.

The intermediate transfer belt 10 serving as an intermediate transfer member is provided under the tandem image forming unit 20 at substantially the center of the main unit 100. The intermediate transfer belt 10 is stretched around a plurality of support rollers 14, 15, 15', and 16 and configured to rotate clockwise in FIG. 1. In the illustrated example, a cleaning device 17 for cleaning the intermediate transfer belt 10 is provided on the left side of the support roller 16 to remove residual toner remaining on the intermediate transfer belt 10 after image transfer.

On an upper portion of the intermediate transfer belt 10 stretched between the support rollers 14 and 15, the four image forming units 18Y, 18M, 18C, and 18K are laterally aligned in the rotation direction of the intermediate transfer belt 10 to form the tandem image forming unit 20.

As illustrated in FIG. 1, the two exposure devices 21 are disposed above the tandem image forming unit 20, with the left exposure device 21 corresponding to the two image forming units 18Y and 18M and the right exposure device 21 corresponding to the two image forming units 18C and 18K. Each of the exposure devices 21 consists of an optical scanning exposure device including, for example, two light source devices (e.g., semiconductor lasers, semiconductor laser arrays, or multi-beam light sources), two coupling optical systems, an optical deflector (e.g., polygon minor) shared by the two systems, and two scanning imaging optical systems. In accordance with image information of the Y, M, C, and K colors, the exposure devices 21 expose the photoconductors 40Y, 40M, 40C, and 40K for the respective colors to form thereon electrostatic latent images. Hereinafter, the suffixes Y, M, C, and K will be omitted where the distinction between the colors is unnecessary.

In each image forming unit 18, the photoconductor 40 is surrounded by the charging device 37, the development device 38, and the photoconductor cleaning device 39. The charging device 37 uniformly charges the photoconductor 40, and the corresponding exposure device 21 exposes the photoconductor 40 as described above to form an electrostatic latent image. Then, the development device 38 develops the electrostatic latent image with the toner of the corresponding color to form a toner image. Thereafter, the toner image is transferred, and the photoconductor cleaning device 39 removes post-transfer residual toner remaining on the photoconductor 40.

At respective primary transfer positions for transferring the toner images from the photoconductors 40Y, 40M, 40C, and 40K onto the intermediate transfer belt 10, primary transfer rollers 62Y, 62M, 62C, and 62K serving as primary transfer devices are disposed facing the photoconductors 40Y, 40M, 40C, and 40K, respectively, via the intermediate transfer belt 10.

Among the plurality of support rollers 14, 15, 15', and 16 supporting the intermediate transfer belt 10, the support roller 14 serving as a drive roller for driving the intermediate transfer belt 10 to rotate is connected to a motor via a drive transmission mechanism including gears, pulleys, belts, and so forth (not illustrated).

The main unit 100 further includes a moving mechanism (not illustrated) that moves the support rollers 15 and 15' excluding the support roller 14 serving as the drive roller to separate the photoconductors 40Y, 40M, and 40C for the Y, M, and C colors from the intermediate transfer belt 10 when forming a black monochrome image on the intermediate transfer belt 10.

On a lower portion of the intermediate transfer belt 10 opposite to the upper portion thereof adjacent to the tandem image forming unit 20, a secondary transfer device 22 is provided which includes a secondary transfer facing roller 16 and a secondary transfer roller 16'. In the illustrated example, the secondary transfer device 22 presses the secondary transfer roller 16' against the secondary transfer facing roller 16 to generate a transfer electric field on the intermediate transfer belt 10. Thereby, the toner image on the intermediate transfer belt 10 is transferred onto a sheet S as an example of a recording medium (also referred to as a transfer medium).

In FIG. 1, the fixing device 1 is disposed on the left side of the secondary transfer device 22 to fix the unfixed toner image transferred to the sheet S. The fixing device 1 of the present embodiment includes a heating roller 2 as an example of a heating member, a fixing roller 3 as an example of a fixing member, an endless fixing belt 4 as an example of a fixing member, and a pressure roller 5 as an example of a pressure member, all of which are rotary members. The fixing device 1 further includes a later-described separation unit 70.

Figure 2:
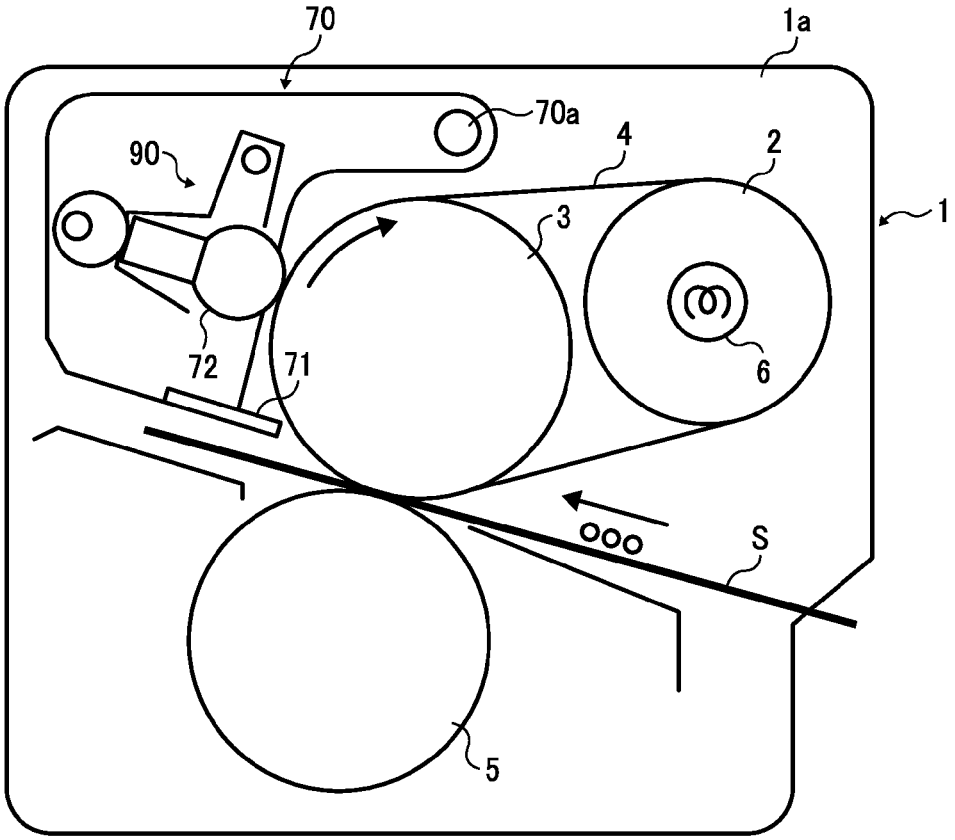
FIG. 2 is a diagram illustrating a fixing device employed in the image forming apparatus of FIG. 1.

The fixing device 1 of the present embodiment employs a belt fixing system, in which the pressure roller 5 is pressed against the fixing belt 4 to form a fixing nip. The fixing belt 4 is stretched around the heating roller 2 and the fixing roller 3, i.e., two support rollers serving as support rotary members. At least one of the heating roller 2 and the fixing roller 3 is provided with a heating device (i.e., heat source), such as a heater, a lamp, or an electromagnetic induction heating device. In the present embodiment, a heating device 6 is provided in the heating roller 2, as illustrated in FIG. 2.

The fixing device 1 of FIG. 1 employing the above-described belt fixing system further includes a driving device (not illustrated) that drives and rotates the heating roller 2 to cause the fixing belt 4 to rotate clockwise in the direction of arrow D to transport the sheet S.

The sheet S having the toner image transferred thereto by the secondary transfer device 22 is transported to the fixing device 1 by a transport belt 24 supported by two rollers 23. The transport belt 24 may be replaced by a fixed guide member or transport rollers, for example.

In the illustrated example, the sheet reversing device 28 is disposed below the secondary transfer device 22 and the fixing device 1 to extend parallel to the tandem image forming unit 20. The sheet reversing device 28 reverses and transports the sheet S to a sheet reverse path 30 to form images on both surfaces of the sheet S.

The image forming apparatus 1000 in FIG. 1 performs an image forming operation (also referred to as image formation or printing) on the basis of image information received from a personal computer (not illustrated) as an example of a computer. The image forming apparatus 1000 starts the image forming operation in full-color mode or monochrome mode in accordance with the mode set by an operation unit of the personal computer.

If the full-color mode is selected, the photoconductors 40Y, 40M, 40C, and 40K rotate counterclockwise in the direction of arrows E in FIG. 1. Then, respective outer circumferential surfaces of the photoconductors 40Y, 40M, 40C, and 40K are uniformly charged by the charging devices 37Y, 37M, 37C, and 37K, and exposed to exposure beams (e.g., laser beams) corresponding to images of the respective colors directed by the exposure devices 21. Thereby, electrostatic latent images corresponding to image data of the respective colors are formed on the photoconductors 40Y, 40M, 40C, and 40K. In accordance with the rotation of the photoconductors 40Y, 40M, 40C, and 40K, the electrostatic latent images thereon are developed with toners of the respective colors by the development devices 38Y, 38M, 38C, and 38K for the respective colors. Thereby, toner images of the respective colors are formed. In accordance with the rotation of the intermediate transfer belt 10, the toner images of the respective colors are sequentially transferred onto the intermediate transfer belt 10, forming thereon a full-color image. After the image transfer, the photoconductors 40Y, 40M, 40C, and 40K are optically discharged by respective discharge lamps (not illustrated), and post-transfer residual toners are removed by the photoconductor cleaning devices 39Y, 39M, 39C, and 39K. Therefore, the charging device 37, the development device 38, and the corresponding exposure device 21 cooperate to form the image of the Y, M, C, or K color on the photoconductor 40.

The sheet feeding table 200 includes a sheet bank 43 housing a plurality of sheet feeding cassettes 44, sheet feed rollers 42, separation rollers 45, transport rollers 47, and a sheet feed path 46. In a sheet feeding operation, one of the sheet feed rollers 42 is selectively rotated. Thereby, a sheet S is picked up from the corresponding sheet feeding cassette 44, separated from the other sheets S and fed to the sheet feed path 46 by the corresponding separation roller 45, and fed to a sheet feed path 48 of the main unit 100 by the transport rollers 47. Then, the leading end of the sheet S is stopped by a registration roller pair 49.

In a manual sheet feeding operation, a sheet feed roller pair 50 is rotated to pick up a sheet S on a manual feed tray 51 and feed the sheet S to a manual sheet feed path 53. Then, the leading end of the sheet S is similarly stopped by the registration roller pair 49. Thereafter, the registration roller pair 49 is rotated in proper timing with the movement of the full-color image on the intermediate transfer belt 10 to feed the sheet S to a nip between the intermediate transfer belt 10 and the secondary transfer device 22 to transfer the toner image onto the sheet S at the secondary transfer device 22.

The sheet S having the toner image transferred thereto is transported to the fixing device 1 by the secondary transfer device 22 and the transport belt 24 and subjected to heat and pressure by the fixing device 1 to fix the toner image on the sheet S. The sheet S is then guided by a switching pawl (not illustrated) to be discharged onto a sheet discharge tray 57 by a discharge roller pair 56. Alternatively, the sheet S is changed in sheet transport direction by the switching pawl to be guided to the sheet reversing device 28, and is reversed and fed again to the secondary transfer device 22. Then, another image is recorded on the other surface of the sheet S, and the sheet S is discharged onto the sheet discharge tray 57 by the discharge roller pair 56. If there is an instruction to perform the image formation on a plurality of sheets S, the above-described image forming process is repeated.

If the monochrome mode is selected, the support rollers 15 and 15' are lowered to separate the intermediate transfer belt 10 from the photoconductors 40Y, 40M, and 40C. Thereby, only the photoconductor 40K is rotated counterclockwise in FIG. 1. Then, the outer circumferential surface of the photoconductor 40K is uniformly charged by the charging device 37K and exposed to the exposure beam (e.g., laser beam) corresponding to the image of the K color, thereby forming an electrostatic latent image. The electrostatic latent image is then developed with the K toner of the development device 38K, thereby forming a toner image. The toner image is transferred onto the intermediate transfer belt 10. In this process, the photoconductors 40Y, 40M, and 40C and the development devices 38Y, 38M, and 38C for the three colors other than the K color are stopped. Therefore, unnecessary wear and consumption of the photoconductors 40Y, 40M, and 40C and developer are prevented.

Meanwhile, a sheet S is fed from one of the sheet feeding cassettes 44 and further fed by the registration roller pair 49 in proper timing with the movement of the toner image formed on the intermediate transfer belt 10. Then, similarly as in the image formation in the full-color mode, the toner image is transferred onto the sheet S and fixed thereon by the fixing device 1, and the sheet S is discharged through the sheet discharge route according to the specified mode. If there is an instruction to perform the image formation on a plurality of sheets S, the above-described image forming process is repeated.

FIG. 2 is a diagram illustrating the configuration of the fixing device 1 according to the present embodiment. In FIG. 2, the fixing device 1 of the present embodiment includes a housing 1*a* housing the heating roller 2, the fixing roller 3, the fixing belt 4, the pressure roller 5, and the separation unit 70 described above. The separation unit 70 has a common configuration including a shaft 70*a* and a separation plate 71. The separation plate 71 serving as a separation member for separating the sheet S from the fixing belt 4 is provided in an opening in the separation unit 70. According to the present embodiment, the separation unit 70 further includes a rubbing roller 72, which will be described in detail later.

The fixing belt 4 is an endless belt having a multilayer structure in which an elastic layer made of silicone rubber, for example, and a release layer are sequentially laminated on a base layer made of polyimide (PI) resin and having a layer thickness of 90 μm. The elastic layer of the fixing belt 4 has a layer thickness of approximately 200 μm, and is made of an elastic material such as silicone rubber, a fluororubber, or foamed silicone rubber. The release layer of the fixing belt 4 has a layer thickness of approximately 20 μm, and is made of tetrafluoroethylene-perfluoroalkyl vinyl ether copolymer resin (PFA), polyimide, polyetherimide, polyether sulfide (PES), or the like. With the release layer formed as a surface layer of the fixing belt 4, releasability (i.e., separability) of the fixing belt 4 from the toner (i.e., toner image) is ensured. Consequently, the fixing belt 4 effectively fixes the toner image on the sheet S and is smoothly releasable from the sheet S.

In the separation unit 70 of the present embodiment, the separation plate 71 is provided as the separation member disposed near the exit of the fixing nip to separate the sheet S from the fixing belt 4. The separation plate 71, however, may be replaced by another member such as a separation pawl, for example. To facilitate an unjamming process of removing a sheet jammed in or near an area B in FIG. 8, the separation unit 70 is installed in the housing 1*a* of the fixing device 1 to be rotatable about the shaft 70*a*.

The rubbing roller 72 included in the separation unit 70 serves as a rubbing member that rubs against and restores the outer circumferential surface of the fixing belt 4. The rubbing roller 72 is driven to rotate by a driving device (not illustrated) different from the driving device that drives the fixing belt 4. The rubbing roller 72 is disposed downstream of the separation plate 71 in the rotation direction of the fixing belt 4. In the fixing device 1 illustrated in FIG. 2, the rubbing roller 72 is disposed in an opening in the separation unit 70 facing the fixing belt 4 and located above the separation plate 71. With the rubbing roller 72 thus disposed inside the separation unit 70, not as an independent unit, an increase in size of the fixing device 1 is prevented. Since the rubbing roller 72 is configured to rub against the fixing belt 4, the rubbing roller 72 is driven to rotate in a rotation direction counter to the rotation direction of the fixing belt 4 in an area of contact between the rubbing roller 72 and the fixing belt 4. Alternatively, the rubbing roller 72 and the fixing belt 4 may be driven to rotate in the same rotation direction but at different speeds.

Figure 3:
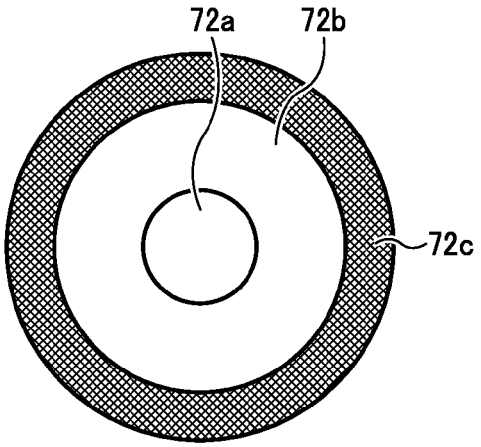
FIG. 3 is a cross-sectional view of a rubbing roller in the fixing device of FIG. 2.

FIG. 3 is a cross-sectional view of the rubbing roller 72 illustrating the configuration thereof. As illustrated in FIG. 3, the rubbing roller 72 includes a shaft 72*a*, a core rod 72*b* around the shaft 72*a*, and a rubbing layer 72*c* made of a binder resin dispersed with abrasive grains and disposed around the core rod 72*b*. The abrasive grains project from the outer circumferential surface of the rubbing layer 72*c*, forming minute irregularities on the surface. The abrasive grains may be alumina abrasive grains, which are commonly used abrasive grains. Although not illustrated, the rubbing roller 72 has a width corresponding to substantially the entire width of the fixing belt 4 such that the rubbing roller 72 comes into contact with the entire fixing belt 4 in the width direction.

If the thus-configured rubbing roller 72 is in constant contact with the fixing belt 4, the surface layer of the fixing belt 4 is unnecessarily rubbed and scraped away, thereby shortening the life of the fixing belt 4. Therefore, the rubbing roller 72 is controlled by a contacting and separating mechanism 90 described below to come into contact with the fixing belt 4 only when the grinding by the rubbing roller 72 is necessary.

Figure 4:
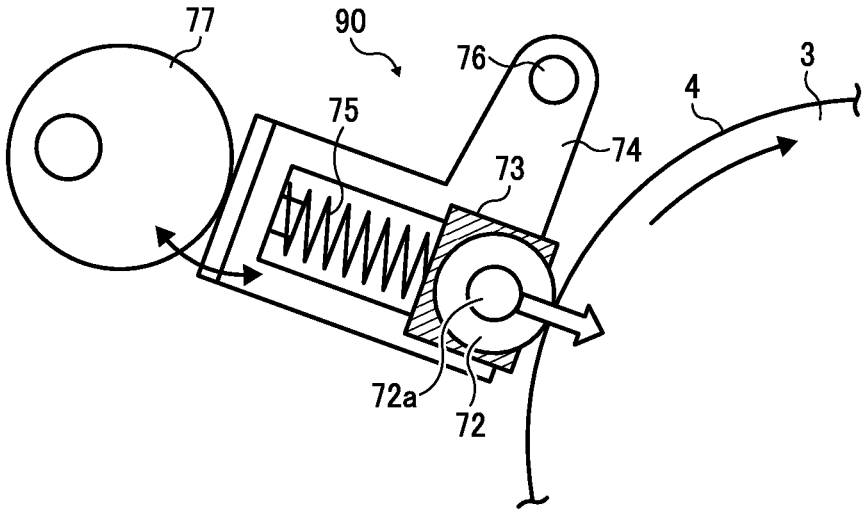
FIG. 4 is a diagram illustrating a rubbing roller contacting and separating mechanism with the rubbing roller in contact with a fixing belt of the fixing device.
Figure 5:
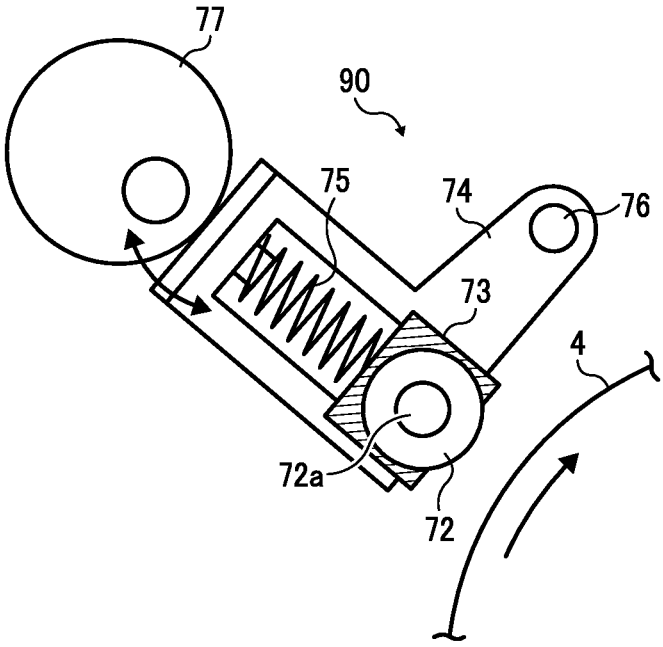
FIG. 5 is a diagram illustrating the rubbing roller contacting and separating mechanism with the rubbing roller separated from the fixing belt.

FIGS. 4 and 5 are diagrams illustrating a configuration of the contacting and separating mechanism 90 for the rubbing roller 72. FIG. 4 illustrates a state in which the rubbing roller 72 is in contact with the fixing belt 4. FIG. 5 illustrates a state in which the rubbing roller 72 is separated from the fixing belt 4.

The contacting and separating mechanism 90 includes a rubbing bracket 74, a shaft 76, and a pair of bearings 73, compression springs 75, and eccentric cams 77. The bearings 73, the compression springs 75, and the eccentric cams 77 are provided to opposed end portions of the rubbing bracket 74 in the axis direction thereof, although FIGS. 4 and 5 illustrate only the bearing 73, the compression spring 75, and the eccentric cam 77 on one of the opposed end portions of the rubbing bracket 74.

In FIG. 4, the shaft 72*a* of the rubbing roller 72 is rotatably supported by the bearing 73, which is supported by the rubbing bracket 74 to be movable in a direction of causing the rubbing roller 72 to contact with and separate from the fixing belt 4. The rubbing roller 72 is biased by the compression spring 75 with resilient force in a direction of causing the rubbing roller 72 to contact with the fixing belt 4. The rubbing roller 72 pressed by the compression spring 75 is prevented from falling from the rubbing bracket 74 by a stopper (not illustrated). Therefore, the rubbing roller 72 is kept at the position illustrated in FIG. 5, at which the rubbing roller 72 partially projects from the rubbing bracket 74 toward the fixing belt 4. In the state of FIG. 4 in which the rubbing roller 72 is in contact with the fixing belt 4, the compression spring 75 is pressed in a compressing direction, thereby generating contact pressure of the rubbing roller 72 on the fixing belt 4.

The rubbing bracket 74 is installed in a case of the separation unit 70 illustrated in FIG. 2 to be rotatable about the shaft 76 as a rotation fulcrum. One side of the rubbing bracket 74 opposite to the other side thereof having the rubbing roller 72 is in contact with the eccentric cam 77 for the contact and separation of the rubbing roller 72. The rubbing bracket 74 is biased by a torsion coil spring 79 illustrated in FIGS. 6 and 7 with rotational force in a direction of causing the rubbing bracket 74 to rotate about the shaft 76 clockwise in FIG. 4, i.e., in a direction of separating the rubbing roller 72 from the fixing belt 4. With the resilient force of the torsion coil spring 79, the rubbing bracket 74 is reliably kept in contact with the eccentric cam 77 to follow the rotation of the eccentric cam 77. With the rotation of the eccentric cam 77, the rubbing roller 72 moves between the position illustrated in FIG. 4 at which the rubbing roller 72 is in contact with the fixing belt 4 and the position illustrated in FIG. 5 at which the rubbing roller 72 is separated from the fixing belt 4, i.e., the rubbing roller 72 comes into contact with and separates from the fixing device 4. The eccentric cam 77 is rotated by driving force transmitted from the fixing device 1.

Figure 6:
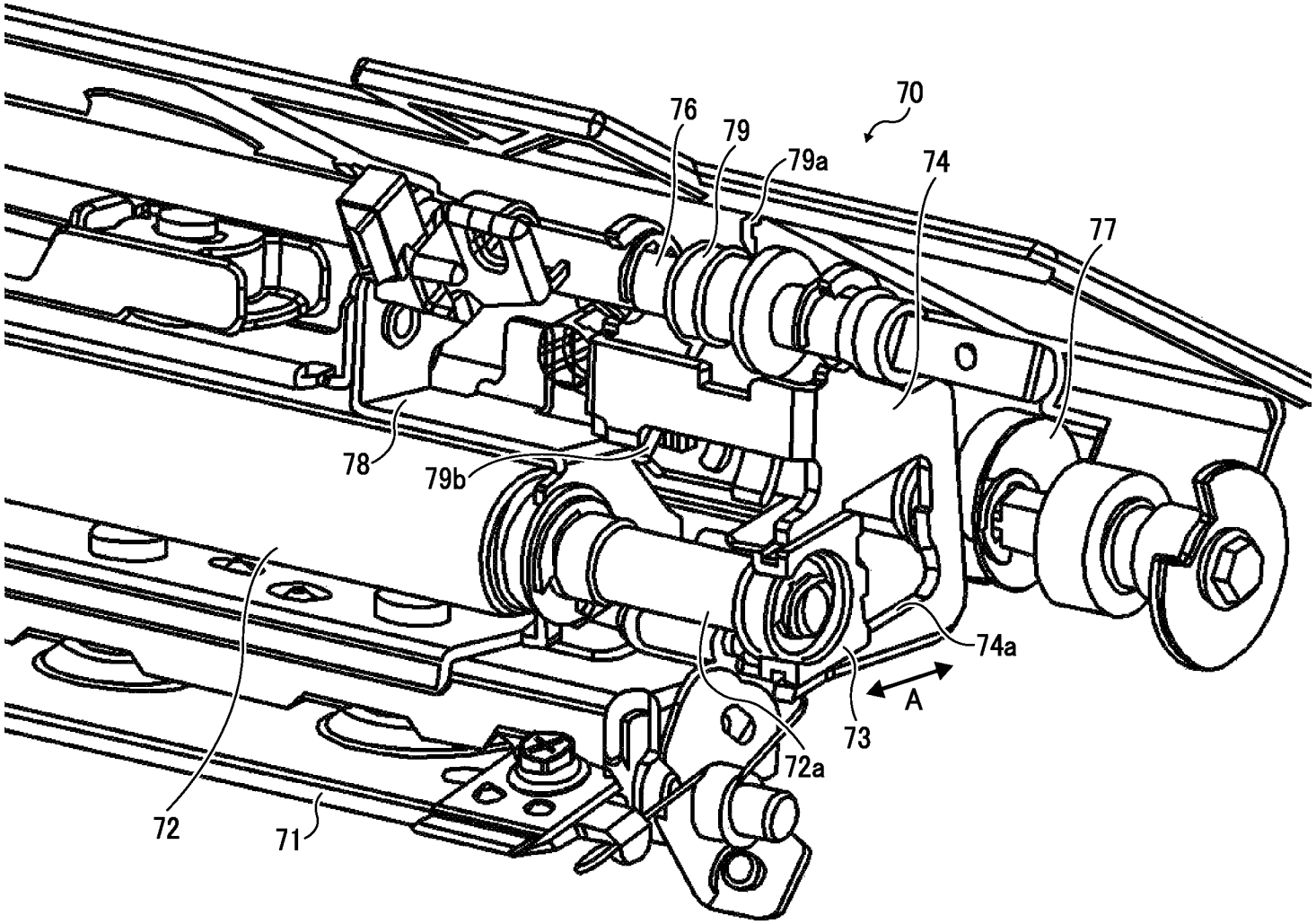
FIG. 6 is a perspective view of a separation unit of the fixing device viewed obliquely from below.

The configuration of the rubbing roller 72 in the separation unit 70 will now be described in more detail. FIG. 6 is a perspective view of the separation unit 70 viewed obliquely from below. The rubbing roller 72 is rotatably installed in a roller case 78 near opposed end portions of the shaft 72*a* of the rubbing roller 72. FIG. 6 illustrates only one of the opposed end portions. The outermost end of each of the opposed end portions is attached by the corresponding bearing 73. The bearing 73 is formed to have a substantially rectangular exterior and installed in a U-shaped fitting groove 74*a* of the rubbing bracket 74 to be movable in the direction of arrow A. Therefore, the rubbing roller 72 is movable relative to the rubbing bracket 74 in the direction of arrow A corresponding to the direction of contacting with and separating from the fixing belt 4. Further, the rubbing roller 72 is biased by the compression spring 75 illustrated in FIGS. 4 and 5 in the direction of contacting with the fixing belt 4. The bearing 73 for the rubbing roller 72 is prevented from falling from the fitting groove 74*a* of the rubbing bracket 74 by the above-described stopper.

Figure 7:
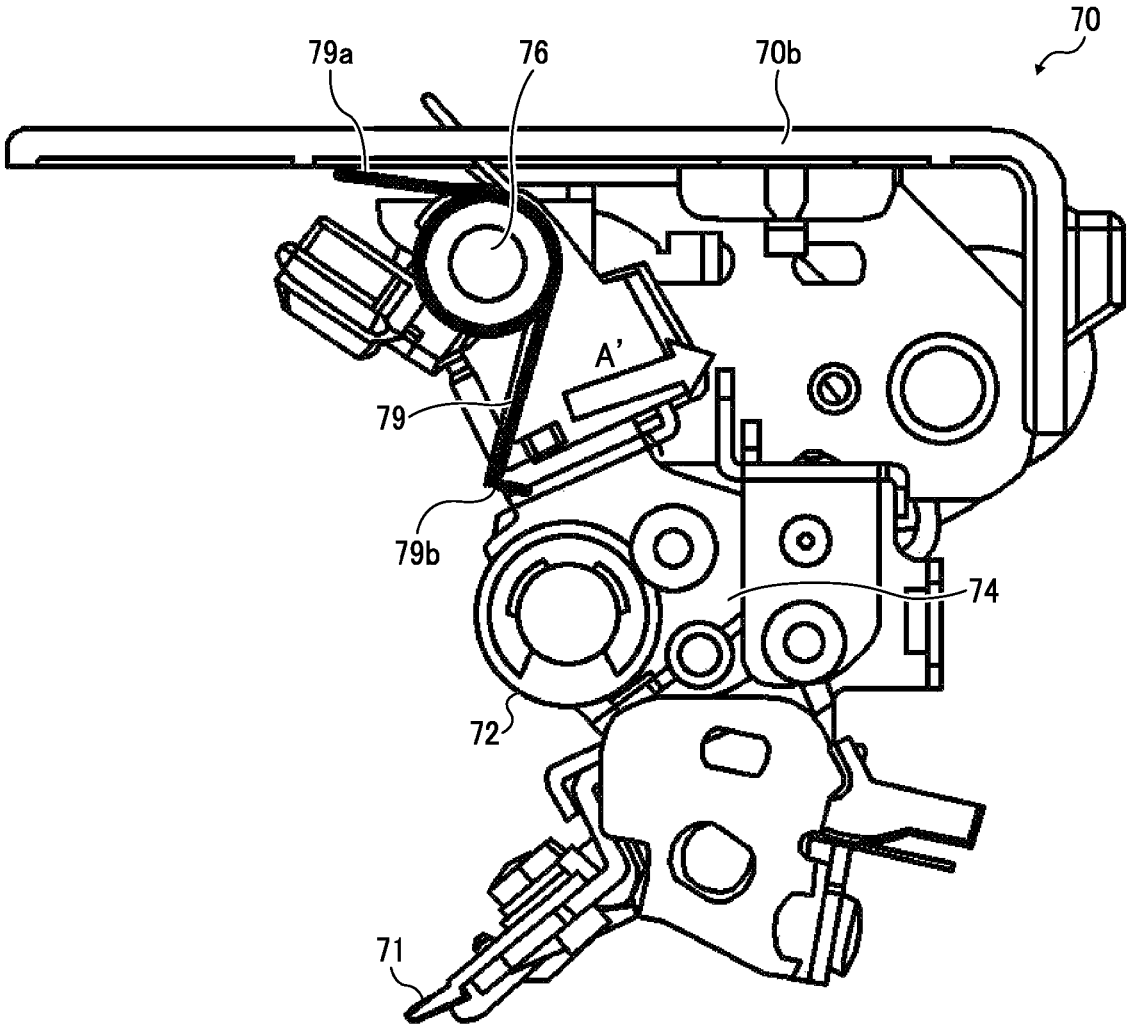
FIG. 7 is a side view of the separation unit.

FIG. 7 is a side view of the separation unit 70, in which the rubbing bracket 74 is constantly biased by the torsion coil spring 79 in the direction of contacting with the eccentric cam 77 illustrated in FIGS. 4 and 5. Specifically, the torsion coil spring 79 is wound around the shaft 76 with one end portion 79*a* contacting with a top panel 70*b* of the separation unit 70 and the other end portion 79*b* locked to press the rubbing bracket 74 obliquely right upward as indicated by arrow A' in FIG. 7.

The above-described rubbing roller 72 is configured to grind and restore the damaged surface of the fixing belt 4, and thus is an expendable component that is degraded in grinding performance with time. Therefore, the rubbing roller 72 has a shorter life than the other components of the separation unit 70. Since the degraded grinding performance results in deterioration of image quality, it is desirable that the rubbing roller 72 be periodically replaced with a new one independently from the other components.

The present embodiment is configured to facilitate replacement work of the rubbing roller 72, as described below. FIG.

8 is a diagram illustrating the movement of the separation unit 70 in the unjamming process. To facilitate the replacement work of the rubbing roller 72, it is desirable to provide a sufficient workplace. The rubbing roller 72 of the present embodiment is provided in the separation unit 70, as described above. The separation unit 70 is configured to be rotatable upward to facilitate the unjamming process when a jam occurs in the area B illustrated in FIG. 8. If the separation unit 70 is further rotated rightward from the upper position illustrated in FIG. 8, the entire rubbing roller 72 is exposed, providing a sufficient workplace in an upper area with no need for an operator to change the posture.

Figure 9:
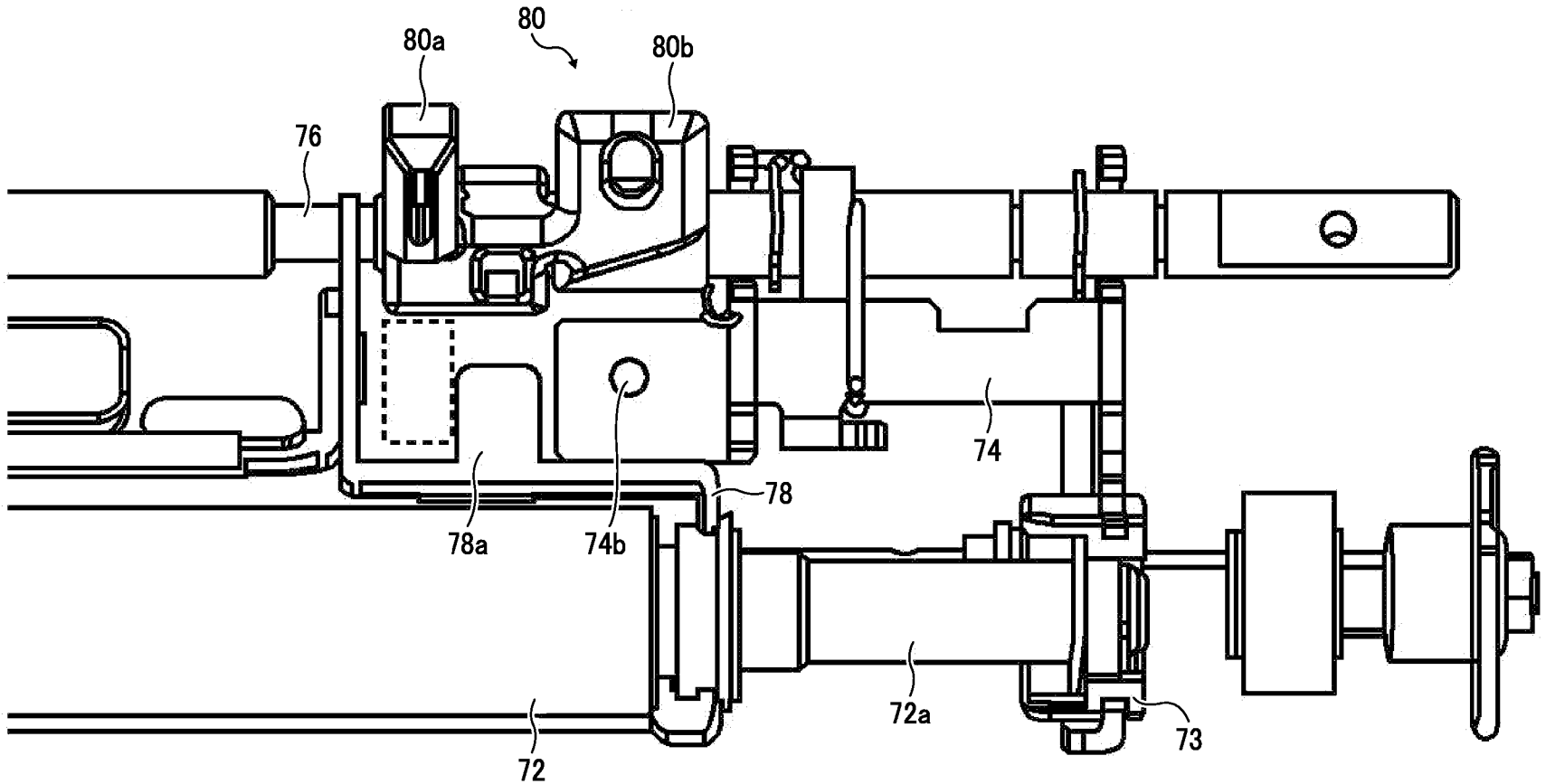
FIG. 9 is an enlarged front view of an end portion in the axial direction of the rubbing roller and the periphery thereof.

FIG. 9 is an enlarged front view of one end portion in the axial direction of the rubbing roller 72 and the periphery thereof. As illustrated in FIGS. 6 and 9, the rubbing roller 72 of the present embodiment is configured to be removable together with the roller case 78 by moving the rubbing roller 72 toward the left side of the drawings in the axial direction of the shaft 72*a* and removing the shaft 72*a* from the bearing 73. The roller case 78 includes a projection 78*a* that comes into contact with a stopper 80 rotatably attached to the shaft 76, thereby preventing displacement of the rubbing roller 72 in the axial direction. That is, the stopper 80 serves as a regulation member that regulates the movement in the axial direction of the rubbing roller 72.

Further, the stopper 80 is attached to the shaft 76 to be rotatable about the shaft 76 between the position indicated by a broken line in FIG. 9 at which the stopper 80 is in contact with the projection 78*a* and the position indicated by a solid line in FIG. 9 at which the stopper 80 is separated from the projection 78*a*. Further, the stopper 80 is locked by the other end portion 79*b* of the torsion coil spring 79 and biased with rotational force for rotating the stopper 80 toward the position at which the stopper 80 is separated from the projection 78*a*.

As illustrated in FIG. 9, the stopper 80 includes a stopping portion 80*a* and a fixing portion 80*b* integrated with each other. The fixing portion 80*b* and the rubbing bracket 74 are fixed by a screw (not illustrated) screwed in a screw hole 74*b* formed in the rubbing bracket 74. Thereby, the stopping portion 80*a* is held at the position indicated by the broken line in FIG. 9.

Figure 10:
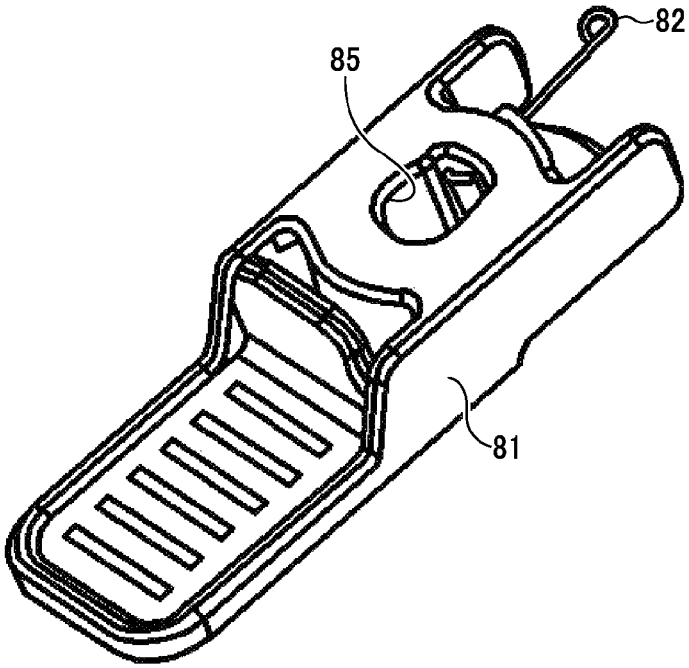
FIG. 10 is a perspective view of an example of an operation unit for use in the replacement of the rubbing roller.
Figure 11:
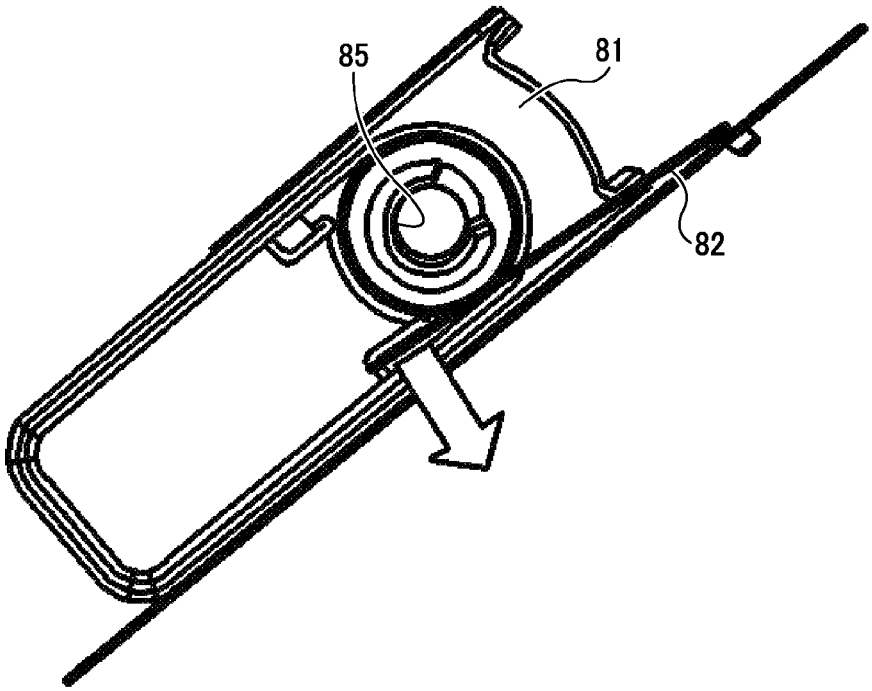
FIG. 11 is a plan view of the operation unit.

FIGS. 10 and 11 are a perspective view and a plan view, respectively, of an operation unit for use in the replacement of the rubbing roller 72. An operation piece 81 serves as the operation unit used to move the rubbing roller 72 in the axial direction in the removal thereof, and is provided at two positions on the roller case 78. As illustrated in FIGS. 10 and 11, the operation piece 81 is an elongated rectangular member, which is supported to be rotatable between a standby position and a use position. At the standby position illustrated in FIG. 12, the operation piece 81 overlap a plate member of the roller case 78 in the longitudinal direction of the roller case 78. When rotated to the use position from the standby position, the operation piece 81 protrudes forward from the plate member of the roller case 78.

The operation piece 81 includes an elongated hole 85, the diameter of which changes depending on the position, and a torsion spring 82. If the operation piece 81 is moved to protrude by a certain distance, the operation piece 81 spontaneously moves to the use position to be held at the position owing to the elongated hole 85 and resilient force of the torsion spring 82. The force for keeping the operation piece 81 at the use position is weak. That is, the operation piece 81 is configured to resiliently return to the standby position when lightly pressed. Therefore, even if the separation unit 70 is returned to a use position thereof (i.e., the position illustrated in FIG. 2) when the operation piece 81 rotated to protrude forward for the replacement of the rubbing roller 72 is kept at the use position, the operation piece 81 comes into contact with the fixing belt 4 and spontaneously returns to the standby position.

Figure 12:
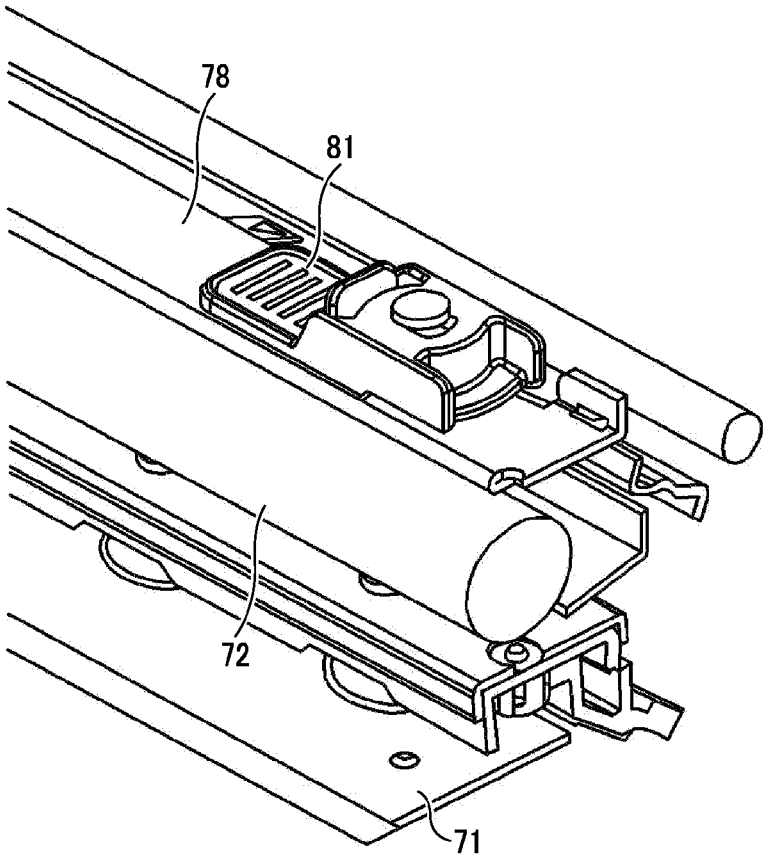
FIG. 12 is a perspective view of the operation unit at a standby position.

The operation piece 81 is thus configured to be movable between the standby position and the use position, and is stored to overlap the roller case 78 at the standby position without protruding from the roller case 78, as illustrated in FIG. 12. Accordingly, the presence of the operation piece 81 does not increase the size of the fixing device 1.

Figure 8:
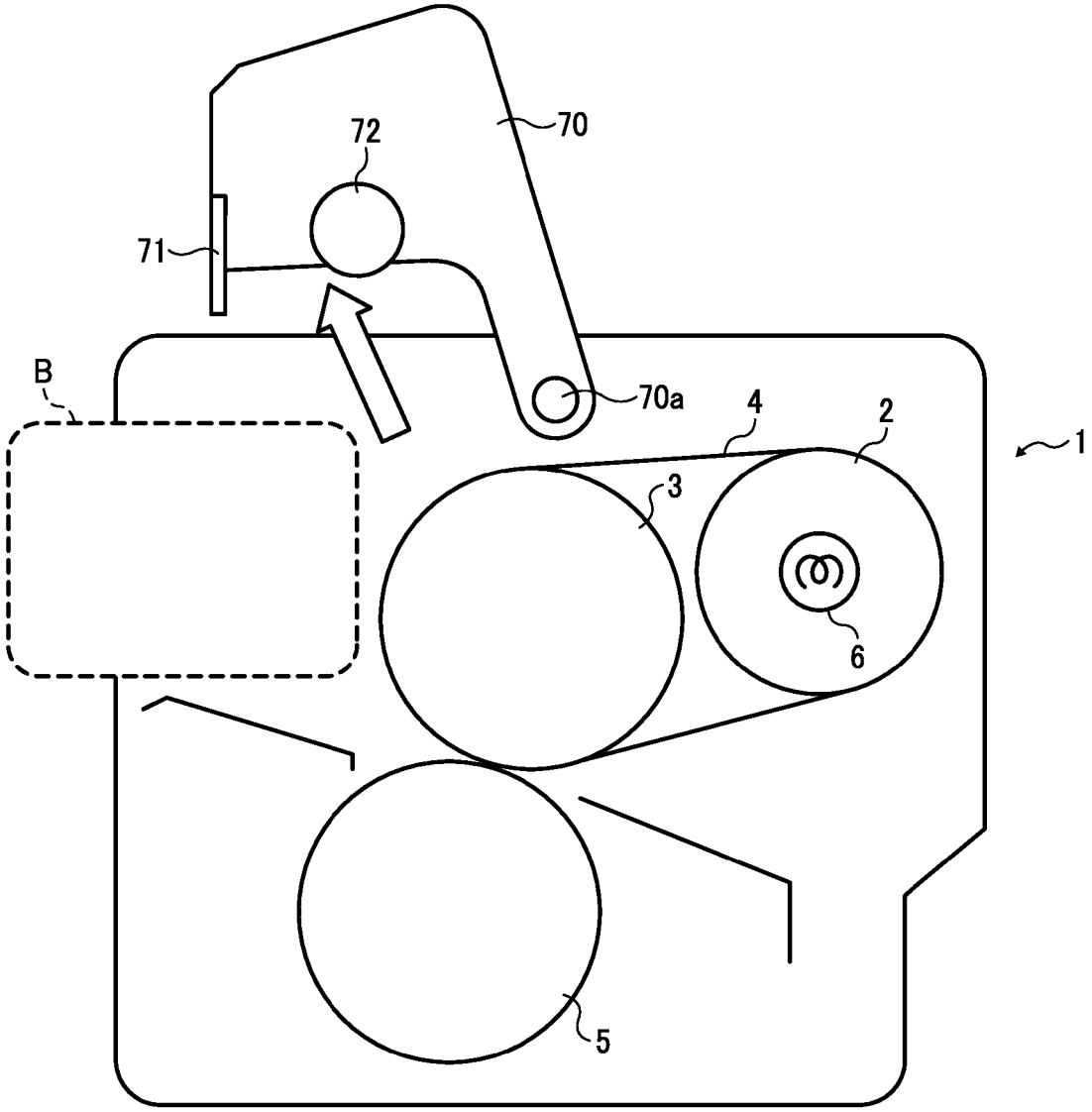
FIG. 8 is a diagram illustrating movement of the separation unit.

Description will now be given of a procedure for removing the rubbing roller 72. The separation unit 70 is first rotated upward, as illustrated in FIG. 8, similarly as in the unjamming process. Then, the not-illustrated screw screwed in the screw hole 74*b* formed in the rubbing bracket 74 is removed. Thereby, the stopper 80 is flipped up by the resilient force of the torsion coil spring 79, as illustrated in FIG. 9. Then, the operation piece 81 is rotated to protrude to the use position, and the rubbing roller 72 is moved in the axial direction with the operation piece 81. Thereby, the shaft 72*a* comes out of the bearing 73, allowing the removal of the rubbing roller 72. That is, the above-described regulation of the movement in the axial direction of the rubbing roller 72 by the stopper 80 is releasable when the separation unit 70 is moved away from the fixing belt 4.

As described above, the rubbing roller 72 is disposed inside the separation unit 70. Therefore, the presence of the rubbing roller 72 does not increase the size of the fixing device 1. Further, operations such as replacement and checkup of the rubbing roller 72 are performed with the separation unit 70 rotated upward as done in the unjamming process. Therefore, the replacement of the rubbing roller 72 as an expendable component is easily performed. Further, the rubbing roller 72 is removed from the rubbing bracket 74 provided with the contacting and separating mechanism 90 that causes the rubbing roller 72 to contact with and separate from the fixing belt 4. Therefore, the replacement of the rubbing roller 72 does not affect the contacting and separating mechanism 90. That is, the precision alignment of the eccentric cam 77 and the rubbing bracket 74 is maintained irrespective of the replacement of the rubbing roller 72. Further, the replacement of the rubbing roller 72 does not affect the driving device that drives the rubbing roller 72 to rotate. Moreover, the rubbing roller 72 is configured to be removed together with the roller case 78 provided with the operation pieces 81 that protrude forward when operated. This configuration makes the replacement work easy, and prevents an increase in size of the fixing device 1.

Figure 13:
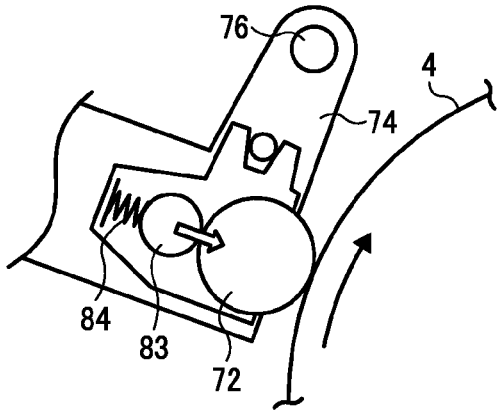
FIG. 13 is a diagram illustrating a modified example of the fixing device employed in the image forming apparatus of FIG. 1.

FIG. 13 is a diagram illustrating a modified example of the fixing device 1 according to the present embodiment. Since the rubbing roller 72 is configured to grind and restore the damaged fixing belt 4, the irregularities of the outer circumferential surface of the rubbing roller 72 tend to be clogged with ground chips over an extended time of use. The fixing device 1 of the present example, therefore, includes a brush roller 83 and a spring 84. The brush roller 83 serves as a cleaning member that cleans the surface of the rubbing roller 72. The spring 84 keeps the brush roller 83 in contact with the brush roller 72. With the rubbing roller 72 thus configured to be cleaned by the brush roller 83, the rubbing roller 72 is extended in life and reduced in replacement frequency.

With the above-described fixing device 1 applied to the image forming apparatus 1000, image defects such as streaky unevenness in image density due to the burred edges of recording media are suppressed without an increase in size of the image forming apparatus 1000. Further, the fixing device 1 allows easy replacement of the rubbing roller 72, facilitating periodical maintenance thereof. Accordingly, the image forming apparatus 1000 is capable of providing high image quality over an extended time.

The fixing device 1 according to the above-described embodiment employs a fixing belt as a fixing member. The present invention, however, is also applicable to a fixing device employing a fixing roller, for example, as a fixing member.

According to an embodiment of the present invention, an increase in size of a fixing device is prevented by a rubbing member (i.e., rubbing roller) disposed inside a separation unit, and the rubbing member is easily replaceable without affecting a contacting and separating mechanism and a driving device for the rubbing member. Accordingly, a fixing device and an image forming apparatus according to an embodiment of the present invention allow easy replacement of the rubbing member without an increase in size of the fixing device and the image forming apparatus.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A fixing device comprising:

a fixing member;

a heating device configured to heat the fixing member;

a pressure member configured to be pressed against the fixing member to form a fixing nip for receiving a recording medium carrying an unfixed toner image and fixing the unfixed toner image on the recording medium; and a separation unit having a surface facing the fixing member and having an opening therein, the separation unit including:

a separation member disposed in the opening in the separation unit to be located near an exit of the fixing nip, and configured to separate the recording medium from the fixing member; and a removable rubbing member housed in the separation unit, contactable with the fixing member through the opening in the separation unit, and configured to rub against a surface of the fixing member to restore the surface condition of the fixing member.

2. The fixing device according to claim 1, wherein the separation unit is configured to be moved in a direction of separating from the fixing member to expose the exit of the fixing nip.

3. The fixing device according to claim 1, wherein the separation unit further includes a rubbing bracket configured to support the removable rubbing member, and the rubbing member is movable in the axial direction thereof.

4. The fixing device according to claim 3, wherein the rubbing bracket includes a regulation member configured to regulate movement in the axial direction of the rubbing member, and wherein the regulation member is releasable when the separation unit is moved away from the fixing member.

5. The fixing device according to claim 1, wherein the separation unit further includes a contacting and separating mechanism configured to cause the rubbing member to contact with and separate from the fixing member.

6. An image forming apparatus including a fixing device, the fixing device comprising:

a fixing member;

a heating device configured to heat the fixing member;

a pressure member configured to be pressed against the fixing member to form a fixing nip for receiving a recording medium carrying an unfixed toner image and fixing the unfixed toner image on the recording medium; and a separation unit having a surface facing the fixing member and having an opening therein, the separation unit including:

a separation member disposed in the opening in the separation unit to be located near an exit of the fixing nip, and configured to separate the recording medium from the fixing member; and a removable rubbing member housed in the separation unit, contactable with the fixing member through the opening in the separation unit, and configured to rub against a surface of the fixing member to restore the surface condition of the fixing member.

7. The fixing device according to claim 1, wherein the rubbing member includes a shaft, a core rod around the shaft, and a rubbing layer made of a binder resin dispersed with abrasive grains and disposed around the core rod.

8. The fixing device according to claim 7, wherein the abrasive grains project from an outer circumferential surface of the rubbing layer, forming minute irregularities on the surface thereof.

9. The fixing device according to claim 1, wherein the rubbing member has a width corresponding to substantially an entire width of the fixing member such that the rubbing member comes into contact with the entire fixing member in the width direction.

10. The fixing device according to claim 5, wherein the contacting and separating member includes a rubbing bracket, a shaft, and a pair of bearings, compression springs, and eccentric cams.

11. The fixing device according to claim 10, wherein the bearings the compression springs, and the eccentric cams are provided to opposed end portions of the rubbing bracket in the axis direction thereof.

12. The fixing device according to claim 11, wherein a shaft of the rubbing member is rotatably supported by the bearing, which is supported by a rubbing bracket to be movable in a direction of causing the rubbing member to contact with and separate from the fixing member.

13. The fixing device according to claim 10, wherein the rubbing member is biased by the compression spring with resilient force in a direction of causing the rubbing member to contact with the fixing member.

14. The fixing device according to claim 3, wherein the rubbing bracket is installed in the separation unit to be rotatable about a shaft acting as a rotation fulcrum.

15. The fixing device according to claim 14, wherein one side of the rubbing bracket opposite to the other side thereof having the rubbing member is in contact with an eccentric cam for the contact and separation of the rubbing member.

16. The fixing device according to claim 3, wherein the rubbing bracket is biased by a torsion coil spring with a rotational force in a direction of causing the rubbing bracket to rotate about a shaft.

17. The fixing device according to claim 16, wherein the torsion coil spring is wound around the shaft with one end portion contacting with a top panel of the separation unit and the other end portion locked to press the rubbing bracket obliquely right upward.

18. The fixing device according to claim 1, wherein with a rotation of an eccentric cam, the rubbing member moves between a position at which the rubbing member is in contact with the fixing member, and a position at which the rubbing member is separated from the fixing member.

19. The fixing device according to claim 1, wherein the rubbing member is rotatably installed in a roller case near opposed end portions of a shaft of the rubbing member.

20. The fixing device according to claim 19, wherein the rubbing member is configured to be removable together with the roller case.

* * * * *